US005285609A

United States Patent [19]

Goad

[11] Patent Number: 5,285,609

[45] Date of Patent: Feb. 15, 1994

[54] LAGGING PANEL

[75] Inventor: Gary N. Goad, Dickson, Tenn.

[73] Assignee: Global Power Company, Wavery, Tenn.

[21] Appl. No.: 934,769

[22] Filed: Aug. 24, 1992

[51] Int. Cl.[5] ..... E04C 3/00

[52] U.S. Cl. ..... 52/588; 52/805

[58] Field of Search ..... 52/404, 406, 407, 474, 52/478, 508, 518, 519, 520, 528, 588, 542, 543, 544, 592, 805, 809

[56] References Cited

U.S. PATENT DOCUMENTS

| | | | |
|---|---|---|---|
| 1,797,706 | 3/1931 | Winslow | 52/805 |
| 3,267,626 | 8/1966 | Daly | 52/588 X |
| 3,961,454 | 6/1976 | Adams . | |

*Primary Examiner*—Carl D. Friedman
*Assistant Examiner*—Creighton Smith
*Attorney, Agent, or Firm*—Hardaway Law Firm

[57] ABSTRACT

A prefabricated insulation panel is provided by identical L-shaped panel halves where a lip on one panel half is secured to a sleeve of a second panel half, the lip of the second panel half similarly engaging the sleeve of the first panel half, providing a double sided panel which can accommodate an insulation layer between the assembled panel halves.

1 Claim, 3 Drawing Sheets

LAGGING PANEL

BACKGROUND OF THE INVENTION

This invention relates to a building panel, and more particularly to a prefabricated insulation panel.

There is a need for a quality, prefabricated insulation panel which can be easily installed, secures the insulation from damage and environmental degradation, is aesthetically pleasing and is stronger than that found in the prior art.

PRIOR ART

Various insulating panels are known and provided by the prior art In U.S. Pat. No. 3,961,454 to Adams, a prefabricated insulation panel is provided having a single panel, insulation material, an open retaining means for holding the insulation in place and attaching flanges and feet for installing the panels. While Adams solved problems in the prior art including deformed panels and the damaging of the insulating material during installation, there is room for further variation and improvement in design.

Exposed insulation on one surface of a panel has inherent disadvantages. While such an arrangement will suffice for its insulating ability in heating apparatuses, boilers, boiler rooms and other similar environments, the exposed surface is aesthetically displeasing when used in more accessible and open areas. Further, the insulation material is subjected to damage through normal wear and tear, harbors dust and debris, is subject to moisture damage, and serves as a possible environmental hazard if the insulating material should start to shed.

SUMMARY OF THE INVENTION

It is therefore an object of this invention to provide a prefabricated insulation panel which encloses the insulation on two sides, thereby creating a more aesthetically pleasing and versatile panel.

It is a further and more particular object of this invention to provide a prefabricated double sided insulation panel, thereby offering a choice of finishes, textures and/or colors provided by a single panel.

It is a further and more particular object of this invention to provide a prefabricated insulation panel having greater strength and rigidity than that found within the prior art.

These and other objects of the invention are accomplished by a pair of identically sized L-shaped panel halves where a lip located on an engaging end of one panel half is inserted into a sleeve of a second panel half. A foot projected from the sleeve of one panel half secures the engaging end of the second panel half. The opposite ends of the panel halves are similarly engaged, providing a double-sided panel which can secure and protect an insulation layer between the interior walls of the panel halves. A groove running the width of the exterior surface of each panel half facilitates the positioning and mounting of sequential prefabricated panels.

DETAILED DESCRIPTION

Figure 1:
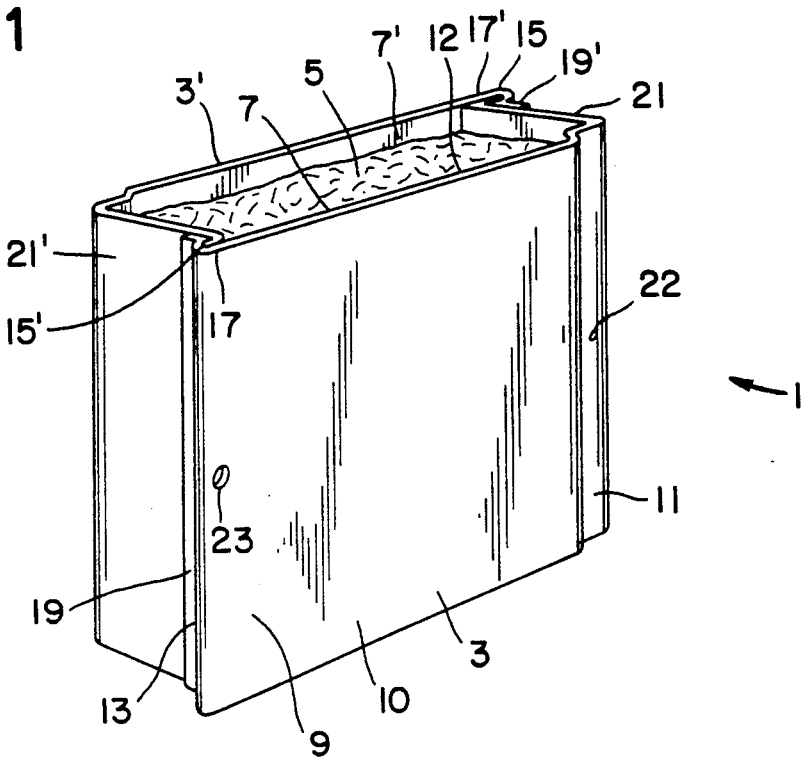
FIG. 1 is a perspective view of one embodiment of a reversible prefabricated insulated panel.

According to this invention, it has been found that a prefabricated insulation panel can be constructed from a first panel half and a second panel half, each panel half further defining a first substantially right angle bend forming an engaging end, a second right angle bend defining a lip at a first terminus, and a sleeve defined by a second terminus; an insulation layer, wherein a lip of a first panel half is inserted into a sleeve of a second panel half, thereby permitting the similar like insertion of a lip of a second panel half into the sleeve of a first panel half, thereby securing the insulation layer in a space between the two panel halves.

In reference to figures through 5, a prefabricated insulation panel 1 is disclosed constructed of two identical panel halves 3 and 3' containing an insulation mat or layer 5 between the two interior faces 7 and 7' of the respective panel halves.

As seen in FIG. 1, each panel half 3 has an exterior surface 10 and an interior surface 12. The exterior surface 10 further defines a front panel face 9 while the interior surface 12 defines a rear insulation face 7 for engaging an insulation mat 5. In reference to FIGS. 1 and 2, one edge of the front panel face 9 has a mounting groove 11 running the width of panel face 9. A receiving terminus 13 of panel half 3 is provided for receiving a lip 15' of a panel half 3'. Ideally, receiving end 13 is formed by an edge portion of panel half 3 which is rolled back against interior face 7 forming a sleeve 17. Sleeve 17 terminates in a projected foot 19 which is perpendicular to and directed away from the interior face 7. Opposite receiving end 13 of panel half 3 is a flat engaging end 21 formed by a substantially right angle bend of panel half 3 towards the interior face 7. Engaging end 21 defines a projecting terminal lip 15, the lip forming a right angle with the exterior surface of engaging end 21.

Figure 2:
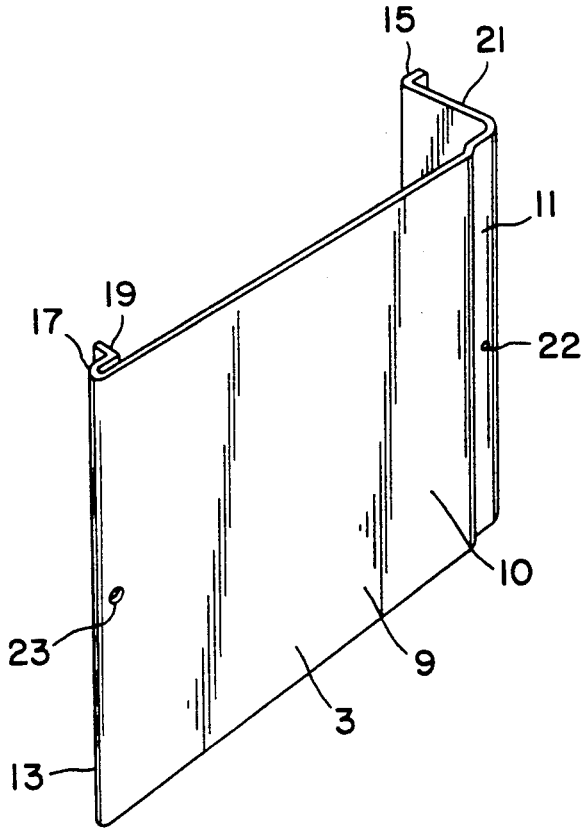
FIG. 2 is a perspective view of a panel half.

Preferably, each panel half seen in FIG. 2 is constructed of sheet metal such as galvanized steel or aluminum. Such material is easily rolled to form the right angle bends which define engaging end 21, lip 15, foot 19 as well as allowing rolled sleeve 17 to be defined by receiving end 13.

A completed panel is assembled positioning two panel halves, 3 and 3' seen in FIG. 1 so that the two interior faces, 7 and 7' respectively, are opposite one another and separated by an insulation mat 5. Panel halves 3 and 3' are positioned so that lip 15 of panel half 3 is inserted into sleeve 17, of panel half 3'. By flexing panels 3 and 3', lip 15' of panel 3' is similarly inserted into sleeve 17 of panel 3. When thus inserted, the two panel pair halves enclose insulation mat 5 with a metal cover. The assembled panel pairs 3 and 3' can be fastened together in a variety of means including screws, rivets or crimping along the lip 15' and sleeve 17 interface.

Figure 5:
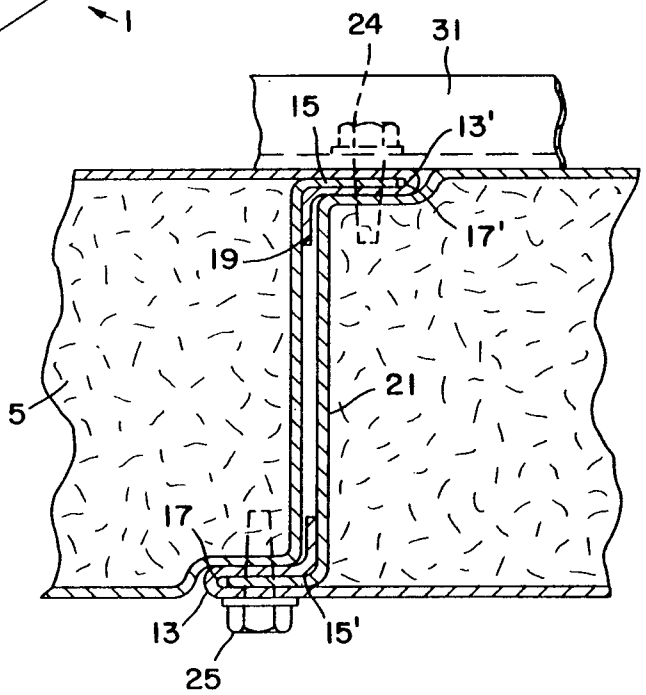
FIG. 5 is an enlarged view, taken from FIG. 4, of the overlapping portions of two panels.
Figure 4:
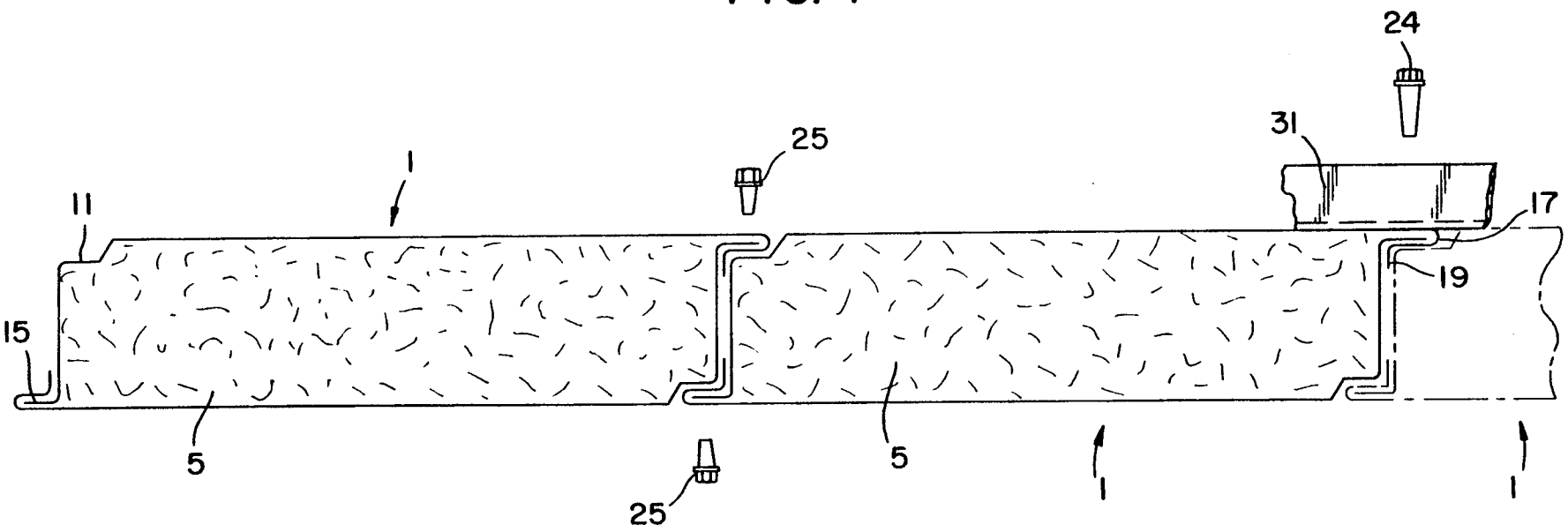
FIG. 4 is a sectional view of FIG. 3 viewed in the direction of line 4—4.

One or more aligned screw holes 23, best seen in FIGS. 1 and 2, traverse panel pair half 3 along the length of lip 15 and sleeve 17. When properly assembled into a panel, screw holes 23 associated with lip 15' are in alignment with the holes 22 in sleeve 17. Similarly, holes 22 in groove 11 on one panel will align with holes 23 along sleeve 17 of an overlapping second panel. The alignment of these holes as best seen in FIGS. 4 and 5, allows screws 25 to be used to secure not only panel pairs together, but permits the attachment of overlapping panels to one another. Further, as seen in FIG. 4, the aligned holes 23 provide one means of attaching the insulated panels to a external support member 31 via screw 24. If desired, rivets, nails or other similar means can be substituted in the place of screws 24 and 25.

Figure 3:
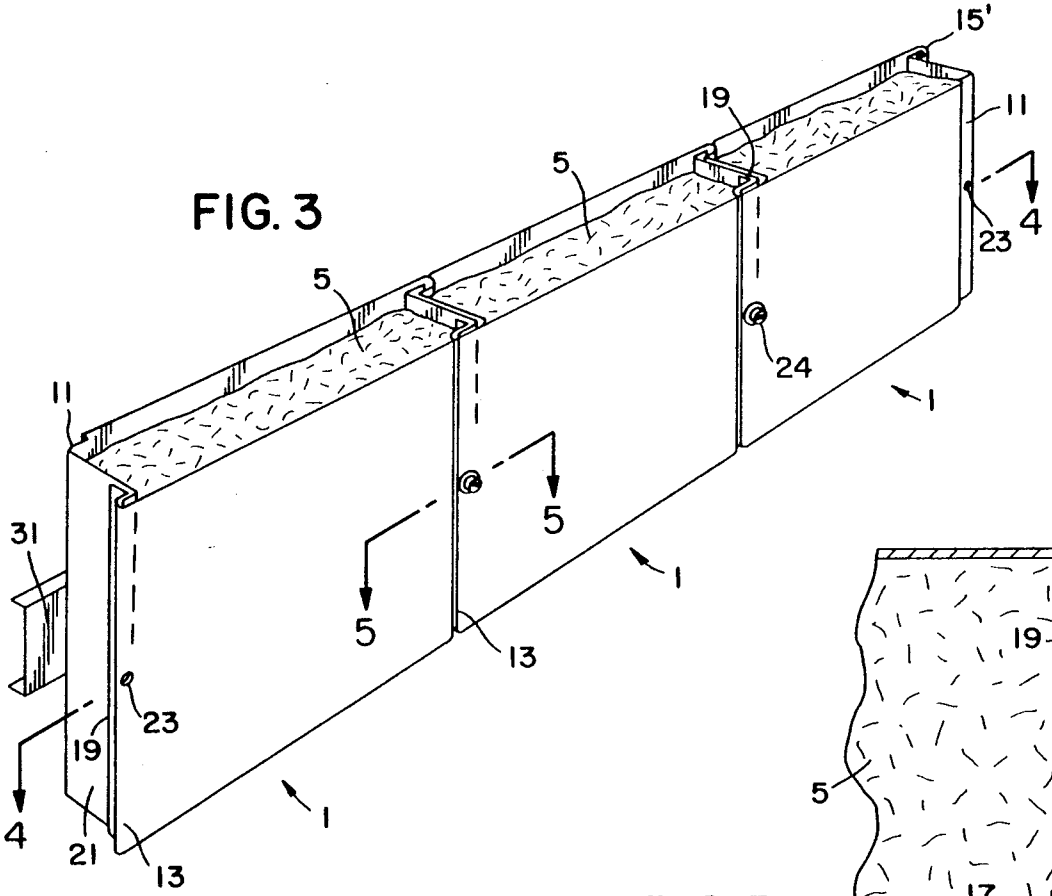
FIG. 3 is a perspective view of overlapping panels showing configuration of panel positioning and orientation.

In reference to FIGS. 3 and 4, a plurality of insulation panels 1 as illustrated in figure 1 can be joined in an overlapping fashion where receiving end 13 of one panel is placed adjacent to groove 11 of a second panel, whereby groove 11 of the first panel similarly engages the receiving end 13 of a second panel. The panels can be attached to each other with screws via a series of aligned holes 22 located along groove 11 and holes 23 associated with sleeve 17 and lip 15' of receiving end 13. Though not shown, a vertical configuration is also possible.

Ideally, sheet metal screws are used to attach overlapping panels. The screws should have a sufficient length to engage the panel half through the aligned holes but should not traverse or significantly puncture the insulation material. This arrangement maintains a high level of insulation integrity. As best seen in FIG. 5, the area surrounding the holes along the mounting groove are sealed not only by the screw, but also by the two surfaces of sleeve 17 as well as the inserted lip 15'. Collectively, the attached sleeve and lip provide a tight seal against air and heat flow as well as a seal which is resistant to moisture.

The double sided panels allow the prefabricated panel to be reversed if desired. Reversal can be used to conceal cosmetic damage to one panel pair, as well as offering a choice of two finishes or colors within one prefabricated panel. Greater strength and rigidity is provided by two panel pair halves forming one completed panel as well as the advantages provided by sealing the insulation from exposure to the elements.

Prefabricated insulation panels are frequently used as the insulation means in boilers, boiler rooms, pipes and duct work. These work environments are frequently very humid and are prone to the release of water from normal maintenance as well as accidents. The enclosed insulation pad protects the insulation from moisture by sealing the insulation in a double sided panel. This protects the insulation from moisture which might compress and thereby reduce the effectiveness of the insulation. Further, the enclosure protects the insulation from damage associated with normal wear and tear and maintenance in these environments.

It is thus seen that a double-sided insulation panel is provided which encloses the insulation layer between two protective panel pair halves, thereby protecting the insulation layer on both sides. In addition, the double sided panel permits a stronger panel to be constructed which further allows a choice of finishes, textures and/or colors to be provided by a single panel.

Many variations of the above invention may be apparent to those skilled in the art from the reading of the description which is exemplary in nature. Such variations are embodied within the spirit and scope of this invention as measured by the following appended claims.

That which is claimed is:

1. A prefabricated insulating panel adapted for assembling in an overlapping relation with other like panels upon a support member comprising:

a first panel half and a second panel half, said first and said second panel half each defining an exterior face and an interior face, an engaging end forming in right angle with said interior face and a receiving end;

a sleeve defined by a portion of said receiving end folded against said interior face, terminating in a projected foot perpendicular to and directed away from said interior face;

a recessed, substantially parallel engaging groove defined by and traversing a width of said exterior face;

a lip carried by a terminus of said engaging end, said lip substantially planar to said interior and exterior faces and directed away from said receiving end;

an insulating layer positioned between said interior faces of said panel halves;

wherein a pair of panel halves accommodating an insulating layer between said respective interior faces in assembled, said lip of said engaging end of a first panel pair half is inserted into said sleeve of said receiving end of a second panel half, thereby forming a reversible panel adapted for assembly with other like fashioned panels by overlapping connection to a support member.

* * * * *